US005795283A

United States Patent [19]

Romer

[11] Patent Number: 5,795,283

[45] Date of Patent: Aug. 18, 1998

[54] DECORATIVE BAG MAKING APPARATUS AND METHOD OF USE

[76] Inventor: Nicholas K. Romer, P.O. Box 614, Bel Air, Md. 21014

[21] Appl. No.: 853,278

[22] Filed: May 9, 1997

[51] Int. Cl.[6] ..... B31B 47/00; B65H 45/12

[52] U.S. Cl. ..... 493/243; 493/210; 493/218; 493/268; 493/405; 493/936; 493/953

[58] Field of Search ..... 493/51, 56, 84, 493/86, 88, 90, 93, 114, 115, 186, 187, 210, 217, 218, 221, 223, 227, 228, 231, 240, 243, 245, 255, 260, 261, 264, 268, 267, 334, 343, 352, 355, 356, 374, 378, 379, 383, 393, 394, 395, 396, 397, 405, 409, 417, 453, 458, 473, 476, 480, 953, 936

[56] References Cited

U.S. PATENT DOCUMENTS

| | | | |
|---|---|---|---|
| 333,523 | 1/1886 | Honiss | 493/218 |
| 1,221,213 | 4/1917 | Plante | 493/396 |
| 2,164,655 | 7/1939 | Kleerup | 493/405 |
| 5,047,001 | 9/1991 | Willis | 493/267 |
| 5,348,526 | 9/1994 | Feygin | 493/458 |
| 5,378,222 | 1/1995 | Weber | 493/405 |
| 5,380,265 | 1/1995 | Giovinazzo | 493/405 |
| 5,484,373 | 1/1996 | Carbone | 493/396 |
| 5,490,828 | 2/1996 | Derby | 493/210 |

*Primary Examiner*—Joseph J. Hail, III
*Assistant Examiner*—Christopher W. Day
*Attorney, Agent, or Firm*—Henderson & Sturm

[57] ABSTRACT

A decorative bag making apparatus 10 and method of use wherein the apparatus 10 comprises a sizing unit 11, a centerpiece unit 12, and a face unit 13 which cooperate with one another and a sheet of decorative material 100 to fabricate a finished decorative bag 110.

26 Claims, 6 Drawing Sheets

DECORATIVE BAG MAKING APPARATUS AND METHOD OF USE

BACKGROUND OF THE INVENTION

1. Field of the Invention

The present invention relates to the field of paper bags and their method of manufacture in general, and in particular to a decorative paper bag making apparatus and its method of use.

2. Description of Related Art

As most consumers are no doubt aware, commercially available decorative bags are rather expensive to purchase and your choice of colors and patterns are limited to those selections provided by the bulk manufacturers of bags of this type.

As a consequence of the foregoing situation, there has existed a longstanding need among the general public for a new type of bag making apparatus that will allow the user to produce an unlimited number of decorative paper bags from an equally limitless supply of various decorative wrapping papers, and the provision of such a construction is a stated objective of the subject matter of this invention.

BRIEF SUMMARY OF THE INVENTION

Briefly stated, the decorative bag making apparatus and method of use that forms the basis of the present invention comprises a sizing unit, centerpiece unit, and a face unit which cooperate with one another, and a sheet of paper to provide all of the creases and folds that are required to produce a finished decorative bag.

In addition, the decorative bag making apparatus further contemplates the provision of a collapsible bag form support unit and a plurality of bag reinforcement units that will facilitate the formation of the bottom panel of the bag and provide the necessary stiffness and reinforcement to the bottom and upper opposed sides of the finished bag, respectively.

As will be explained in greater detail further on in the specification, while the sizing unit is employed to define the outer periphery of the decorative sheet of paper that will be required for the fabrication of the bag, the centerpiece unit and the face unit are employed to form the creases and folds which create the finished product, as well as to define the image that will appear on the widest sides of the finished bags.

It should further be noted that the only accessory items that will be required to produce a finished bag will be a glue applicator, a hole punch and one or more lengths of yarn.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
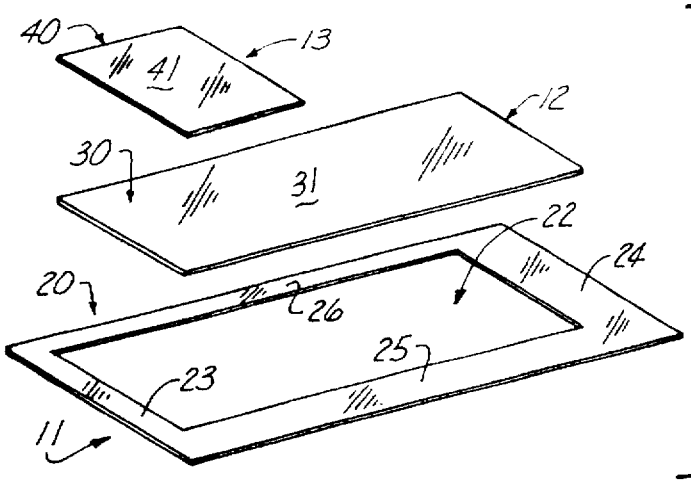
FIG. 1 is an exploded perspective view of the three main components of the bag making apparatus of this invention.
Figure 2:
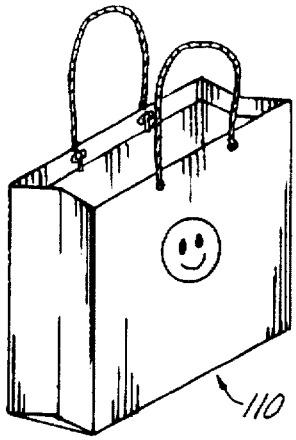
FIG. 2 is a perspective view of a finished bag fabricated in conjunction with the method employed in conjunction with this invention.

As can be seen by reference to the drawings, and in particularly to FIG. 1, the decorative bag making apparatus that forms the basis of the present invention is designated generally by the reference number 10. The bag making apparatus 10 comprises in general, a sizing unit 11, a centerpiece unit 12, and a face unit 13. These units will now be described in seriatim fashion.

Figure 4:
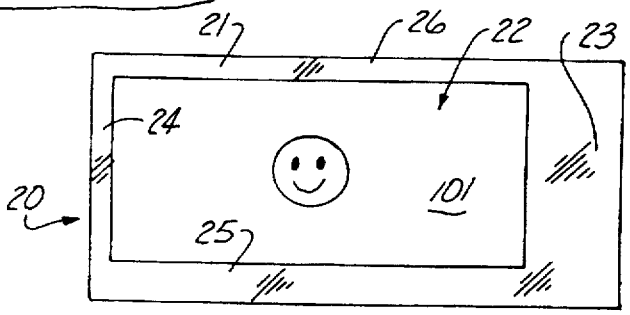

As shown in FIGS. 1 and 4, the sizing unit 11 comprises an enlarged generally rectangular sizing template member 20 fabricated from a generally thin, semi-rigid, sheet of transparent plastic material 21 wherein the sizing template member 20 is further provided with an enlarged offset rectangular opening or window 22 whose purpose and function will be described presently.

In addition, as can best be seen by reference to FIG. 4, the offset opening 22 defines different width segments of material in a surrounding relationship relative to the opening 22 including a relatively wide left bag side segment 23, a relatively thin right underflap segment 24, a relatively wide bottom cuff segment 25, and a relatively narrow top cuff segment 26 whose purpose and function will be explained in greater detail further on in the specification.

Figure 7:
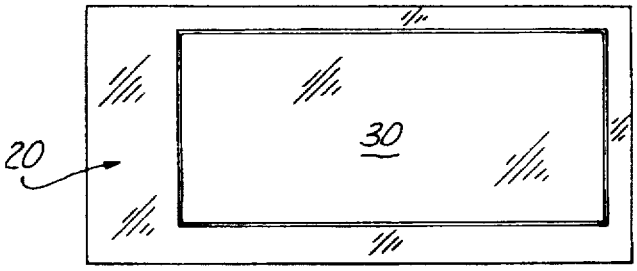

As shown in FIGS. 1 and 7, the centerpiece unit 12 comprises a generally rectangular medium sized centerpiece template member 30 likewise formed from a sheet of transparent plastic material 31. The centerpiece template member 30 is dimensioned to be received within the offset opening 22 of the sizing template member 20.

Figure 13:
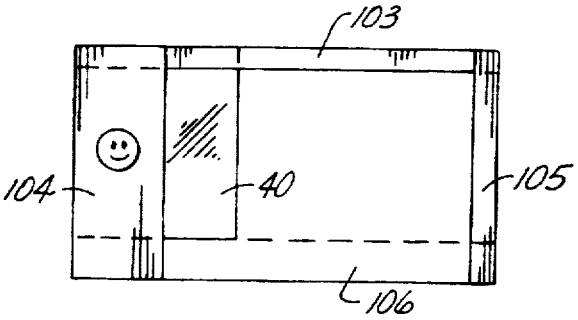

Furthermore, as shown in FIGS. 1 and 13, the face template unit 13 comprises a generally small face template member 40 also formed from a sheet of transparent plastic material 41. The face template member 40 is less than one-half the size of the centerpiece template member 30 and dimensioned to be slideably received in the offset opening 22 in the sizing template member 20.

Prior to embarking on a detailed description of the method steps that are employed in conjunction with the bag making apparatus 10, the following important facts should be noted concerning the units 11, 12, and 13 described thus far.

To begin with, the sizing template unit 20 has an external periphery that will define the outer edges of the surface area of the sheet of decorative material 100 such as paper that will be needed to fabricate the bag 110. In addition, the offset opening 22 will define the image bearing portion 101 of the decorative material that will appear on the exterior surface of the finished bag 200.

Furthermore, the face template member 40 may be laterally translated within the offset opening 22 in the sizing template 20 to determine the images that will appear on the widest panel faces of the finished bag 110. In addition, the centerpiece template member 30 provides a folding guide for the initial paper folding steps that are employed in the bag making process, and also may serve as a stabilizing element for the sizing template member 20 during the initial paper tearing steps as will be explained presently.

Figure 3:
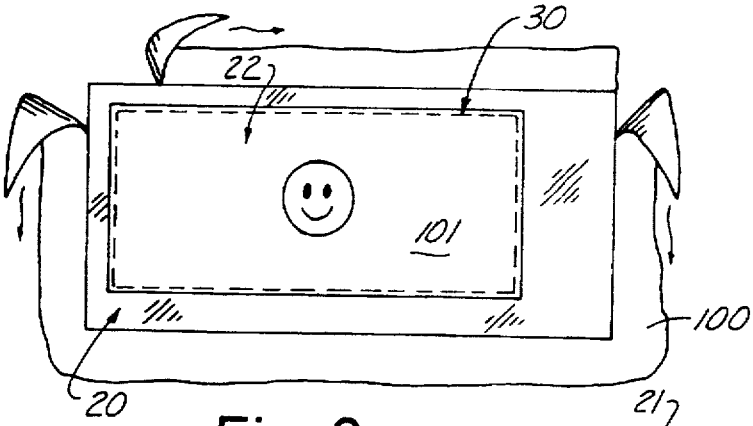
FIGS. 3 through 24 depict all of the sequential tearing, positioning, folding, joining, reinforcing, and finishing steps employed to create a decorative bag using the method and apparatus of this invention.

The first step in the manufacture of a finished bag is illustrated in FIGS. 3 and 4. The sizing template member 20 is positioned on the image bearing surface 101 of a sheet of decorative wrapping paper 10 or the like, such that the preferred image bearing portion of the decorative paper 100 that will appear on the sides of the finished bag 200 will appear within the offset opening 22 in the sizing template member 20.

At this juncture, the decorative paper 100 is torn against the exterior edges of the sizing template member 20 such that the size of the paper 100 will be reduced to the size of the exterior of the sizing template member 20 as depicted in FIG. 4.

Figure 5:
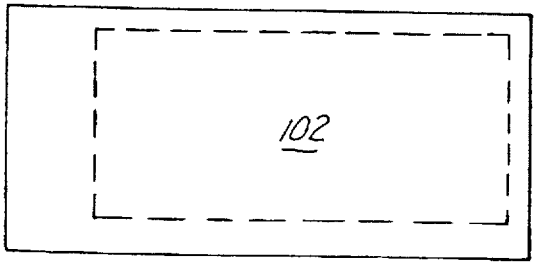
Figure 6:
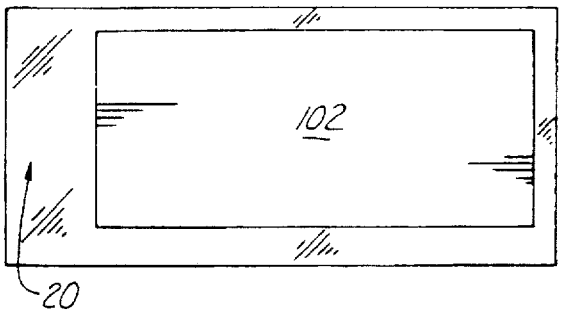

Turning now to FIGS. 5 and 6, it can be seen that the paper and the sizing template member 20 are flipped over such that the plain surface 102 of the paper 100 rests on top of the sizing template member 20 and the sizing template member 20 has been rotated 180° such that it is faced in the opposite direction from its initial orientation, but, both the top 26 and the bottom 25 cuff segments still maintain their original orientation.

At this point, the sizing template member 20 is withdrawn from beneath the sheet of paper 100 and replaced on top of the sheet of paper 100 without otherwise changing the orientation of the sizing template member 20.

Figure 8:
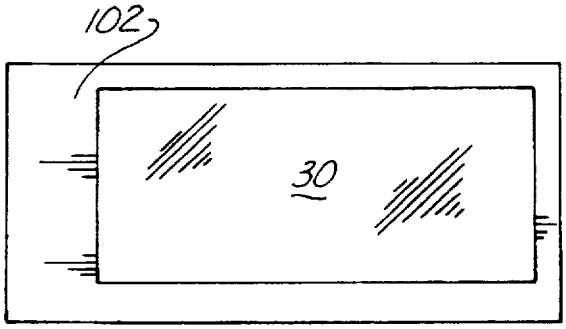

As can be seen by reference to FIGS. 7 and 8, the centerpiece template member 30 is then placed in the offset opening 22 of the sizing template member 20, and then the sizing template member 20 is removed in preparation for the folding phase of the process.

Figure 9:
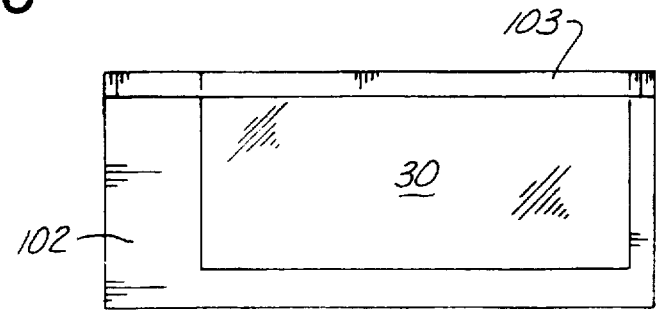
Figure 10:
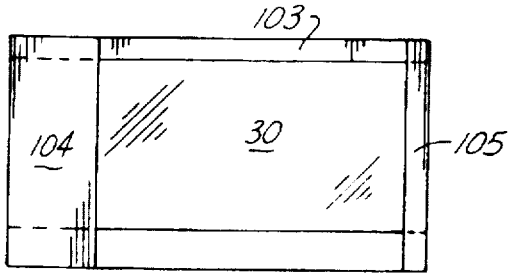
Figure 11:
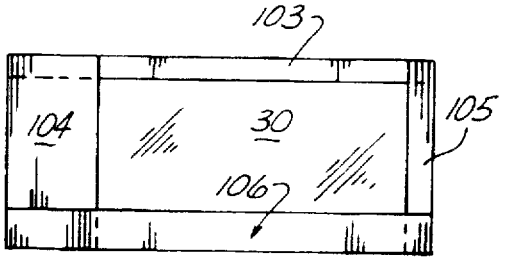

As shown in FIGS. 9 through 12, the centerpiece template member 30 is required for the initial folding steps which must proceed in a very precise sequence. The first fold that takes place is illustrated in FIG. 9 and involves the top bag flap 103 being folded onto the centerpiece template member 30. Then the left side bag flap 104 and the right side underflap 105 are folded against the sides of the centerpiece template member 30 as shown in FIG. 10 followed by the bottom flap 106 depicted in FIG. 11.

Figure 12:
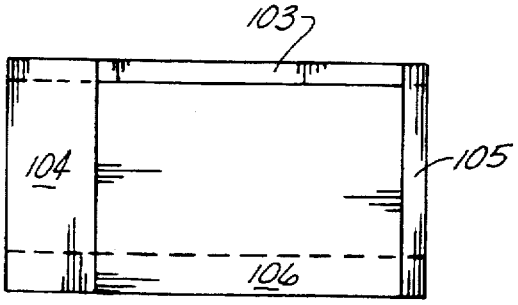

Once the top flap 103 left side bag flap 104 right side underflap 105 and bottom flap 106 folds have been made, the bottom flap 106 is unfolded and the centerpiece template member 30 is removed as shown in FIG. 12.

Figure 14:
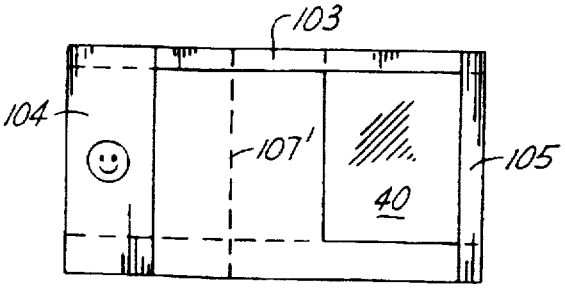

As shown in FIG. 13, the face template member 40 is then inserted into one of the upper corners of the folded paper and vertical fold line 107 is created in a well recognized manner. Then the face template member 40 is shifted into the other upper corner and fold line 108' is likewise formed in a well recognized fashion as shown in FIG. 14.

Figure 15:
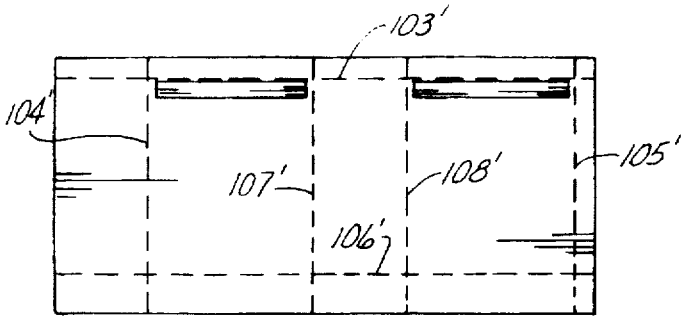

At this juncture, the face template member 40 is removed and the paper is unfolded as in FIG. 15, recreating creased fold line 103', 104', 105', 106', 107' and 108' which will be required to fabricate the finished bag. Still referring to FIG. 15, it can be seen that a pair of elongated rectangular reinforcement panels 109 are adhesively secured to the paper 100 on the largest uncreased portions of the paper beneath fold line 103'.

Figure 16:
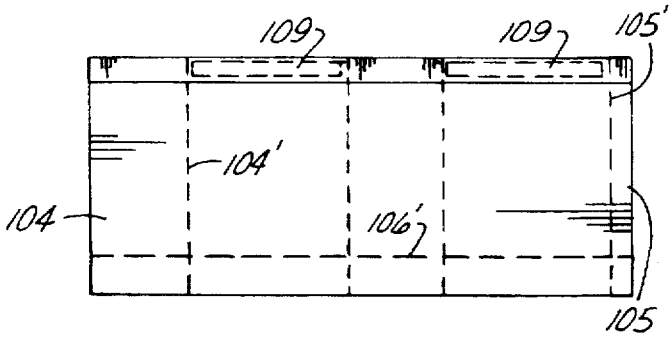

Once the reinforcement panels 109 have been secured in place, that portion of the paper 100 above fold line 103' is coated with adhesive and the top flap 103 is folded back down over the reinforcement panels 109 and the adjacent portion of the paper 100 as shown in FIG. 16.

Figure 17:
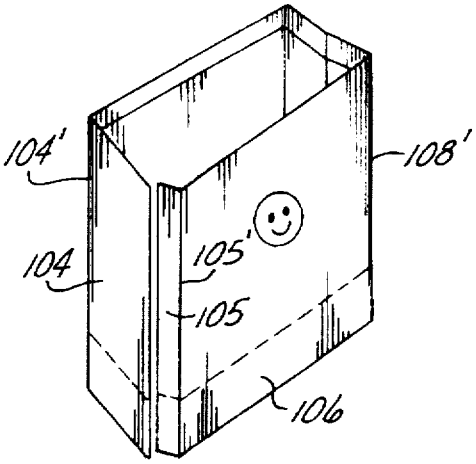
Figure 18:
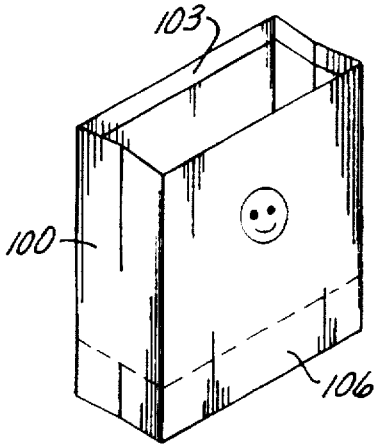

The next step in the process involves adhesively joining the interior of the left side bag flap 104 with the exterior of the right underflap 105 as in FIG. 17, such that the folded paper assumes an open ended rectangular configuration as depicted in FIG. 18.

Figure 19:
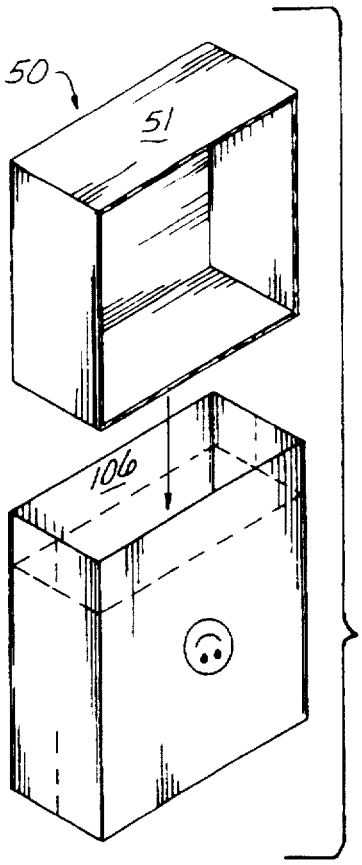
Figure 20:
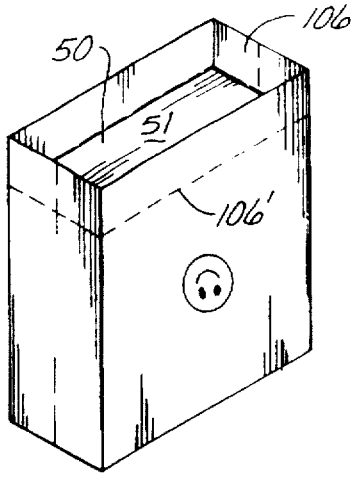
Figure 21:
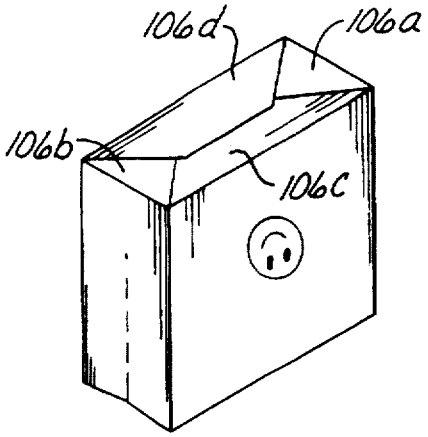

The final folding and gluing steps are illustrated in FIGS. 19 through 21. The open ended rectangular bag form depicted in FIG. 18 is inverted such that the image on the bag form exterior is upside down as shown in FIG. 19. At this juncture, an open rectangular reinforcing framework element 50 is inserted into the interior of the open ended rectangular bag form. The framework element 50 is dimensioned to closely conform to the interior of the finished bag and provided with a top panel 51 which is disposed adjacent to the bottom fold line 106'.

With the framework element 50 positioned within the inverted open ended bag form, the narrow sides **106*a*, 106*b*, of the bottom flap 106 are folded inwardly against the top panel 51 of the framework element 50. Then adhesive is selectively applied to the folded narrow sides 106*a*, 106*b*, and one of the longer sides 106*c* of the bottom flap 106 is folded inwardly into contact with a portion of the adhesively coated narrow sides 106*a*, 106*b*. At this juncture, adhesive is applied to the inboard portion of the first folded longer side 106*c* of the bottom flap 106 and the remaining longer side 106*d*** is folded inwardly to form the bottom of the bag.

Figure 22:
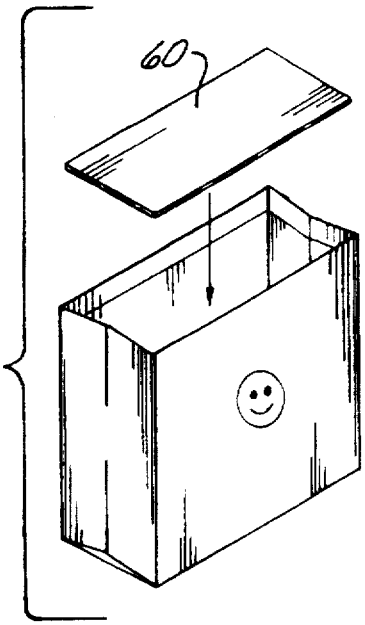

After the adhesive has bonded, the completed bag form is removed from the framework element 50 and inverted once again into the upright position of FIG. 22. A bottom reinforcing panel 60 may be inserted into the interior of the bag and adhesively secured to the interior of the folded bottom flap 106.

Figure 23:
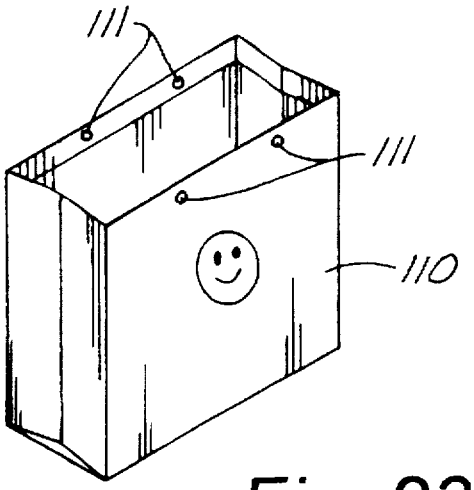
Figure 24:
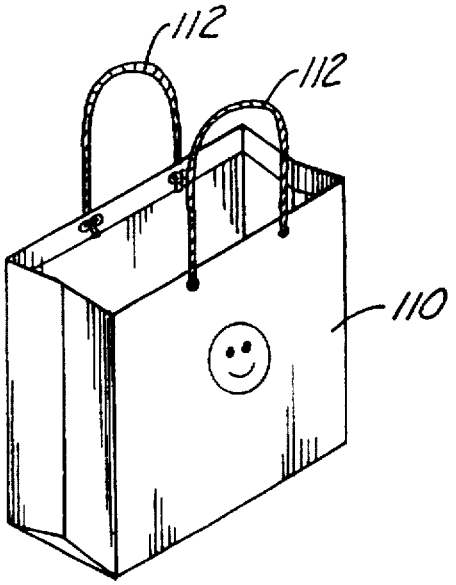

The final steps employed in the fabrication of the finished decorative bag 110 are illustrated in FIGS. 23 and 24 and involve employing a hole punch to form a plurality of discrete holes 111 in the reinforced portions of the top flap 103 and then securing a pair of handle elements 112 through holes 111 in a well recognized manner.

It should also be noted at this juncture that the length of each of the shorter sides of the centerpiece template member 30 correspond to the vertical height of the finished decorative bag 110. Each of the elongated sides of the centerpiece template member 30 correspond to the horizontal periphery of the finished bag 110. In addition, the external periphery of the face template unit 40 corresponds to the periphery of the enlarged face panels of the finished bag 110.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A decorative bag making apparatus for creating a finished bag from a sheet of decorative material having an image bearing side wherein the apparatus comprises:

a sizing unit for defining and creating a periphery of an actual surface area of the sheet of decorative material that will be employed to create the finished bag; wherein, the sizing unit is provided with an enlarged opening;

a centerpiece unit dimensioned to be received within the enlarged opening in the sizing unit; wherein a periphery of the centerpiece unit provides a folding surface to crease the decorative material into a plurality of flaps; and a face unit dimensioned to be received within said enlarged opening in the sizing unit and having an external periphery that corresponds to a periphery of at least one of respective face panels of the finished bag.

2. The apparatus as in claim 1 wherein said sizing unit comprises:

an enlarged, generally thin, flat rectangular sizing template member having an enlarged, generally rectangular, opening formed therein.

3. The apparatus as in claim 2 wherein the centerpiece unit comprises:

a generally, thin, flat rectangular centerpiece template member; wherein, external peripheral dimensions of said centerpiece template member closely correspond to internal peripheral dimensions of said enlarged opening in the sizing template member.

4. The apparatus as in claim 3 wherein said face unit comprises:

a generally small, thin, flat rectangular face template member which is dimensioned to be received within said enlarged opening in the sizing template member.

5. The apparatus as in claim 4 wherein, said face template member is less than one-half a size of the centerpiece template member.

6. The apparatus as in claim 3 wherein the height of the finished bags corresponds to a length of at least one of respective sides of the centerpiece template member.

7. The apparatus as in claim 6 wherein a horizontal periphery of the finished bag corresponds to a length of at least one if respective other sides of the centerpiece template member.

8. The apparatus as in claim 2 wherein said enlarged opening is offset from the center of said sizing template member.

9. The apparatus as in claim 2 wherein the enlarged opening defines a plurality of segments disposed in a surrounding relationship relative to said enlarged opening.

10. The apparatus as in claim 9 wherein said plurality of segments include a top cuff segment, a bottom cuff segment, a left bag side segment, and a right underflap segment.

11. The apparatus as in claim 10 wherein the width of at least two of said segments are different.

12. The apparatus as in claim 11 wherein the width of all of said segments are different.

13. The apparatus as in claim 1 further comprising:

a generally rectangular framework element dimensioned to be received within the partially formed decorative bag to provide a support surface to assist in the fabrication of the bottom panel of the finished bag.

14. The apparatus as in claim 1 wherein the height of the framework element is less than the height of the partially formed decorative bag.

15. A method of fabricating a decorative bag from a sheet of decorative material having an image bearing side and a plain side using a bag making apparatus including a generally rectangular sizing template member having an enlarged rectangular opening formed therein; a rectangular centerpiece template member dimensioned to be received within said enlarged rectangular opening; and, a smaller rectangular face template member dimensioned to correspond to one of respective face panels of a finished bag comprising the steps of:

(a) placing the sizing template member on the image bearing side of the decorative material and maneuvering said enlarged opening over the image bearing side such that the enlarged opening will define the image bearing portions of respective front rear and side panels of the finished bag;

(b) immobilizing the sizing template member relative to the decorative material and tearing the decorative material against the outer peripheral edges of the sizing template member;

(c) turning the decorative material over so that the plain side faces up;

(d) placing the centerpiece template member on top of the plain side of the decorative material; wherein, respective edges of the centerpiece template member are spaced from respective edges of the decorative material;

(e) folding the decorative material against at least respective top and both side edges of the centerpiece template member to form a first the top flap, and then, in random selection fashion, the left side bag flap and the right side underflap;

(f) leaving the top flap, the left side bag flap, and the right side underflap in their folded disposition and sliding a selected corner of the face template member in random selection fashion into one of the corner junctures between the top flap and the left side bag flap and the top flap and the right side underflap;

(g) folding the adjacent unfolded portion of the decorative material against a side edge of the face template member;

(h) repeating steps (f) and (g);

(i) removing the face template member from the decorative material and unfolding said flaps;

(j) applying adhesive to the plain side of said top flap and refolding the top flap;

(k) adhesively securing the image bearing side of the right side underflap to the plain side of the left side bag flap to form an open ended rectangular bag form;

(l) forming a bottom flap in the decorative material; and (m) adhesively joining the sides of the bottom flaps to one another to form the bottom panel of the finished bag.

16. The method as in claim 15 wherein step (l) is an intermediate step between step (e) and step (f).

17. The method as in claim 16 wherein step (l) involves the additional step of folding the decorative material against the bottom edge of the centerpiece template member.

18. The method as in claim 15 wherein step (l) involves the additional intermediate steps of:

(n) inverting the open ended rectangular bag form such that the top flap is disposed on the bottom of the bag form;

(o) inserting an open rectangular framework element into the inverted bag form wherein the top panel of the framework element is disposed below the upper end of the inverted bag form; and (p) folding the opposed sides of the upper end of the inverted bag form against the top panel of the framework element to create said bottom flap.

19. The method as in claim 15 further comprising an intermediate step between steps (i) and (j) comprising:

adhesively securing reinforcement panels to the plain side of the decorative material beneath the fold line that defines the top flap.

20. The method as in claim 19 including the further step of:

(q) attaching handle elements to the reinforced portions of the top flap.

21. The method as in claim 15 including the further step of:

(r) inserting and adhesively joining a bottom reinforcement panel to the interior surface of the bottom flap.

22. A method of fabricating a decorative bag from a sheet of decorative material having an image bearing side and a plain side using a bag making apparatus including: a generally rectangular sizing template member having an enlarged rectangular opening formed therein; a rectangular centerpiece template member dimensioned to be received within said enlarged rectangular opening; and, a smaller rectangular face template member dimensioned to correspond to one of respective face panels of the finished bag comprising the steps of:

(a) employing the sizing template member to sever a specifically dimensioned portion of the sheet of decorative material by tearing the sheet of decorative material against respective peripheral edges of the sizing template member;

(b) placing the centerpiece template member on the specifically dimensioned portion of the decorative material such that the centerpiece template member is spaced from respective sides of the decorative material;

(c) folding portions of the decorative material against selected edges of the centerpiece template member to form a first series of fold lines defining a plurality of flaps in the decorative material;

(d) substituting a face template member for said centerpiece template member and sequentially aligning said face template member adjacent selected ones of said first series of fold lines to form a second series of fold lines by folding respective unfolded portions of the decorative material against selected sides of the face template member;

(e) unfolding said decorative material and adhesively securing one of said plurality of flaps;

(f) adhesively securing two other of said plurality of flaps to form an open ended rectangular bag form; and (g) folding and adhesively securing respective sides of one of the open ends of the rectangular bag forms to create a bottom flap of the finished bag construction.

23. The method as in claim 22 wherein said first series of fold lines define a top flap, a left side bag flap, and right side underflap.

24. The method as in claim 23 wherein in step (e) said one of said plurality of flaps comprises a top flap.

25. The method as in claim 24 wherein step (e) also includes reinforcing said top flaps.

26. The method as in claim 24 further including:

(h) attaching handle elements to said reinforced top flap.

* * * * *